United States Patent [19]

Mizuno et al.

[11] Patent Number: 4,506,266

[45] Date of Patent: Mar. 19, 1985

[54] ANTENNA APPARATUS FOR VEHICLE-MOUNTED RECEIVER/TRANSMITTER EQUIPMENT WITH AUTOMATIC ANTENNA LENGTH CONTROL

[75] Inventors: Masataka Mizuno; Tatsuo Ito; Shuji Sugawara, all of Hyogo; Masakazu Moriyama, Aichi; Masahito Muto, Aichi; Shuji Nakane, Aichi, all of Japan

[73] Assignee: Fujitsu Ten Limited, Kobe, Japan

[21] Appl. No.: 435,881

[22] Filed: Oct. 21, 1982

[30] Foreign Application Priority Data

Oct. 22, 1981 [JP] Japan ..... 56-169740

[51] Int. Cl.[3] ..... H01Q 1/32

[52] U.S. Cl. ..... 343/715; 343/903; 455/289

[58] Field of Search ..... 343/715, 877, 901, 903, 343/200; 455/275, 276, 277, 289

[56] References Cited

U.S. PATENT DOCUMENTS

| | | | |
|---|---|---|---|
| 2,321,556 | 6/1943 | Raskhodoff | 343/877 |
| 2,484,817 | 10/1949 | Armond | 343/877 |
| 3,369,247 | 3/1968 | Bacow | 343/888 |
| 3,380,060 | 4/1968 | Czerwinski | 343/830 |
| 3,380,062 | 4/1968 | George | 343/903 |

FOREIGN PATENT DOCUMENTS

| | | | |
|---|---|---|---|
| 2548583 | 5/1977 | Fed. Rep. of Germany | 343/903 |

*Primary Examiner*—Eli Lieberman

*Attorney, Agent, or Firm*—Wenderoth, Lind & Ponack

[57] ABSTRACT

An antenna for a vehicle-mounted receiver/transmitter includes: a driver for extending and retracting an antenna connected to the receiver/transmitter; a selector for selecting a frequency to be received and/or transmitted by the receiver/transmitter; and a controller which operates in response to an output from the frequency selector for causing the driver to extend and retract the antenna by the length corresponding to the frequency, and for retracting almost the entire antenna into the body of the vehicle when the receiver/transmitter is not operating.

1 Claim, 3 Drawing Figures

ANTENNA APPARATUS FOR VEHICLE-MOUNTED RECEIVER/TRANSMITTER EQUIPMENT WITH AUTOMATIC ANTENNA LENGTH CONTROL

BACKGROUND OF THE INVENTION

1. Field of the Invention

The present invention generally relates to a radio communication equipment and more particularly, to an antenna apparatus for use in receiver/transmitter equipment mounted on a motor vehicle and the like.

2. Description of the Prior Art

Conventionally, when a receiver for receiving amplitude modulation broadcasts and frequency modulation broadcasts, an amateur radio wireless equipment, and a TV receiver, etc. are mounted on a motor vehicle, it has been a common practice to install separate antennas suitable for respective working frequencies on the motor vehicle. Therefore, in the conventional arrangement as described above, there have been such disadvantages that not only the space for the antenna installation tends to be increased, but assembly thereof is undesirably complicated.

Accordingly, it is a primary object of the present invention to provide an antenna device for use in a vehicle-mounted receiver/transmitter equipment, which may be commonly applied to various working frequencies.

SUMMARY OF THE INVENTION

To accomplish the foregoing objectives, there is provided an antenna apparatus for vehicle-mounted receiver/transmitter equipment which comprises driving means for extending and retracting an antenna connected to the receiver/transmitter, a selecting means for selecting a frequency to be received and/or transmitted by means of the receiver/transmitter, and a control means which operates in response to an output from the frequency selecting means for causing the driving means to extend and retract the antenna by the length corresponding to the frequency, and for retracting almost the entire antenna into the body of the vehicle when the receiver/transmitter is not operating.

The control means of the antenna apparatus comprises, a detector for detecting a extended and/or retracted length of the antenna, a switching means for controlling the energization of the driving means in order to extend and retract the antenna, and a processing circuit which operates in response to an output from the selecting means and the detector for controlling a switching mode of the switching means.

The processing circuit of the antenna apparatus stores the position of the antenna at present, and causes the driving means to drive the antenna from the position of the antenna at present to the length indicated by the output of the selecting means so that the length of the antenna is set to the length indicated by the output from the selecting means.

The driving means comprises a motor capable of rotating in the forward and reverse direction, and the antenna which may be a telescopic rod-like whip antenna has a length equal to $\frac{1}{4}$ wavelength of a signal to be received and/or transmitted.

According to the present invention, since the antenna is adopted to be driven for expansion and contraction in its length, it is possible to commonly apply a single antenna according to various frequencies. Moreover, owing to the arrangement that the antenna is advantageously accommodated in the vehicle body, the antenna is protected against theft, while it is safe and free from any possible dangers resulting therefrom.

BRIEF DESCRIPTION OF THE DRAWINGS

This invention will now be illustrated in more detail by reference to embodiment in accompanying drawings.

DETAILED DESCRIPTION OF THE PREFERRED EMBODIMENT

Figure 1:
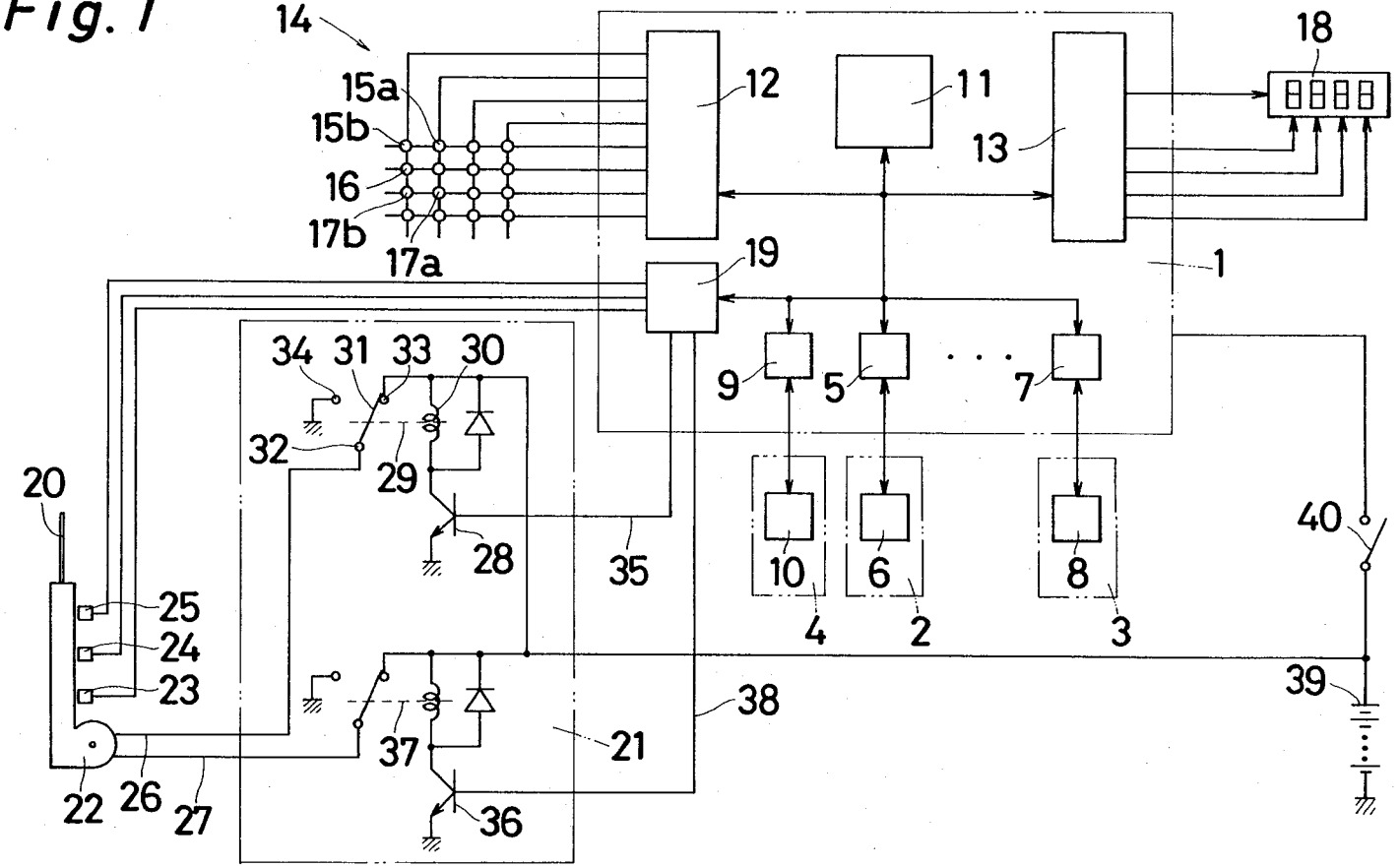
FIG. 1 is an electrical block diagram representing one preferred embodiment of the present invention.

Referring now to FIG. 1, there is shown an electrical block diagram representing one preferred embodiment of the present invention, in which a receiver 2 for receiving amplitude modulation, i.e. AM broadcasts and frequency modulation i.e. FM broadcasts, an amateur radio or ham wireless radio equipment 3, a cassette tape recording/reproducing apparatus 4, etc. are coupled to a processing unit 1 including a microcomputer and the like, through input/output interfaces 5 and 6, 7 and 8, and 9 and 10 respectively. The processing unit 1 is provided with a processing circuit 11 which is connected respectively to the input/output interfaces 5, 7 and 9, and also to input/output interfaces 12 and 13; the input/output interface 12 is connected to a key input device 14, which is provided with mode selection keys 15*a*, 15*b*, 16 and 17 for selecting functions of the receiver 2, amateur wireless equipment 3, and cassette tape recording/reproducing apparatus 4, and further, with keys for selection of other operations. For receiving the amplitude modulation broadcasts by the receiver 2, the key 15*a* of the key input device 14 is actuated, while, for receiving the frequency modulation broadcasts, the key 15*b* is actuated.

The input/output interface 13 is connected to an indicator 18 which displays information related to functions of the receiver 2, amateur wireless equipment 3, and cassette tape recording/reproducing apparatus 4. The processing circuit 11 referred to earlier is also connected to a switching circuit 21 for an antenna 20 through an input/output interface 19. The antenna 20 is installed, for example, at a rear portion of a body of the motor vehicle, and is driven for extention and contraction by a motor 22 capable of rotating in the forward and reverse directions. The antenna 20 may be, for example, of a telescopic rod-like whip antenna. For detecting the length of said antenna 20, there are provided detectors 23, 24 and 25, and the outputs from the detectors 23, 24 and 25 are applied to the input/output interface 19.

Figure 2:
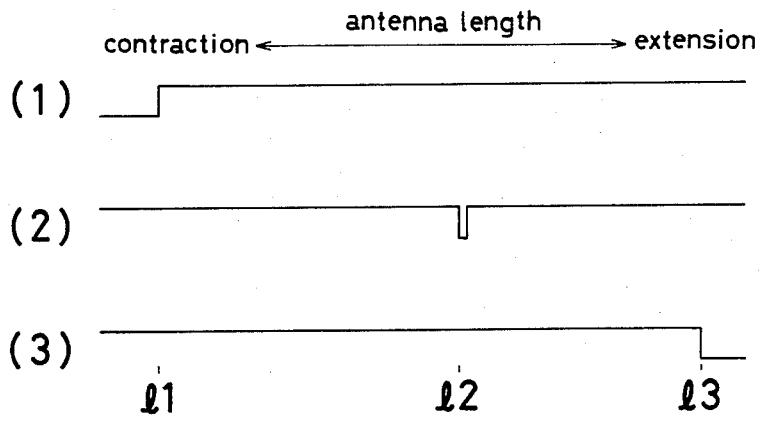
FIG. 2 is waveform diagrams representing outputs from detectors corresponding to lengths of an antenna.

FIG. 2 shows waveform diagrams representing the outputs from the detectors 23, 24 and 25 corresponding to the lengths of the antenna 20, and the output waveforms of said detectors 23, 24 and 25 are respectively illustrated in FIGS. 2(1), 2(2) and 2(3). A lower limit l1 at which approximately the entire length of the antenna 20 is accommodated in the vehicle body, is detected by the detector 23 when the antenna 20 is at the lower limit length l1 as described above, the top portion of the antenna 20 is not protruded from the vehicle body, and thus, not only the antenna 20 is protected against theft, but any possible dangers resulting therefrom may be prevented. The detector 24 is arranged to detect that the length of the antenna 20 has reached l2. Working frequencies for the amateur or ham wireless equipment 3 are, for example, in the range of 144 to 145 MHz, and therefore, for rendering the length l2 of the antenna 20 to be of ¼ wavelength, the length l2 is in such a relation l2=50 cm. The state at an upper limit length l3 where the antenna 20 has been extended to the maximum length is to be detected by the detector 25, and this upper limit length l3 is employed for the frequency modulation broadcasts. Since the frequencies for the frequency modulation broadcasts are in the range of 76 to 90 MHz, the relation will be l3=90 cm for rendering the length l3 of the antenna 20 to be of ¼ wavelength.

Meanwhile, the motor 22 is arranged to drive the antenna 20 for its extension upon application of signal of high level to a line 26, and for its contraction upon receiving of signal of high level to a line 27. The switching circuit 21 includes a transistor 28 and a relay 29 for driving the antenna 20 for the extension, with a relay coil 30 of the relay 29 being connected in series to the transistor 28. Upon energization of the relay coil 30, a common contact 32 of a relay switch 31 is brought into conduction with an individual contact 33, and thus, the line 26 is maintained at high level. On the contrary, upon de-energization of the relay coil 30, the common contact 32 is in conduction with an individual contact 34, and consequently, the line 26 is kept at low level. To the transistor 28, signal is applied from the input/output interface 19 through a line 35. There are similarly provided a transistor 36 and a relay 37 so as to drive the antenna 20 for the contraction, and a signal is applied to the transistor 36 from the input/output interface 19 through a line 38. The arrangement shown in FIG. 1 is supplied with an electric power from a power source 39 of a battery or the like through a power switch 40. The combination of the antenna 20 and the motor 22 is well known to those skilled in the art as the so-called motor antenna or electrically driven antenna.

The signal derived from the input/output interface 19 into the lines 35 and 38 by the processing circuit 11 is altered as shown in Table 1 below through operations of the power switch 40 and the mode selection keys 15*a*, 15*b*, 16 and 17 of the key input device 14.

TABLE 1

Figure 3:
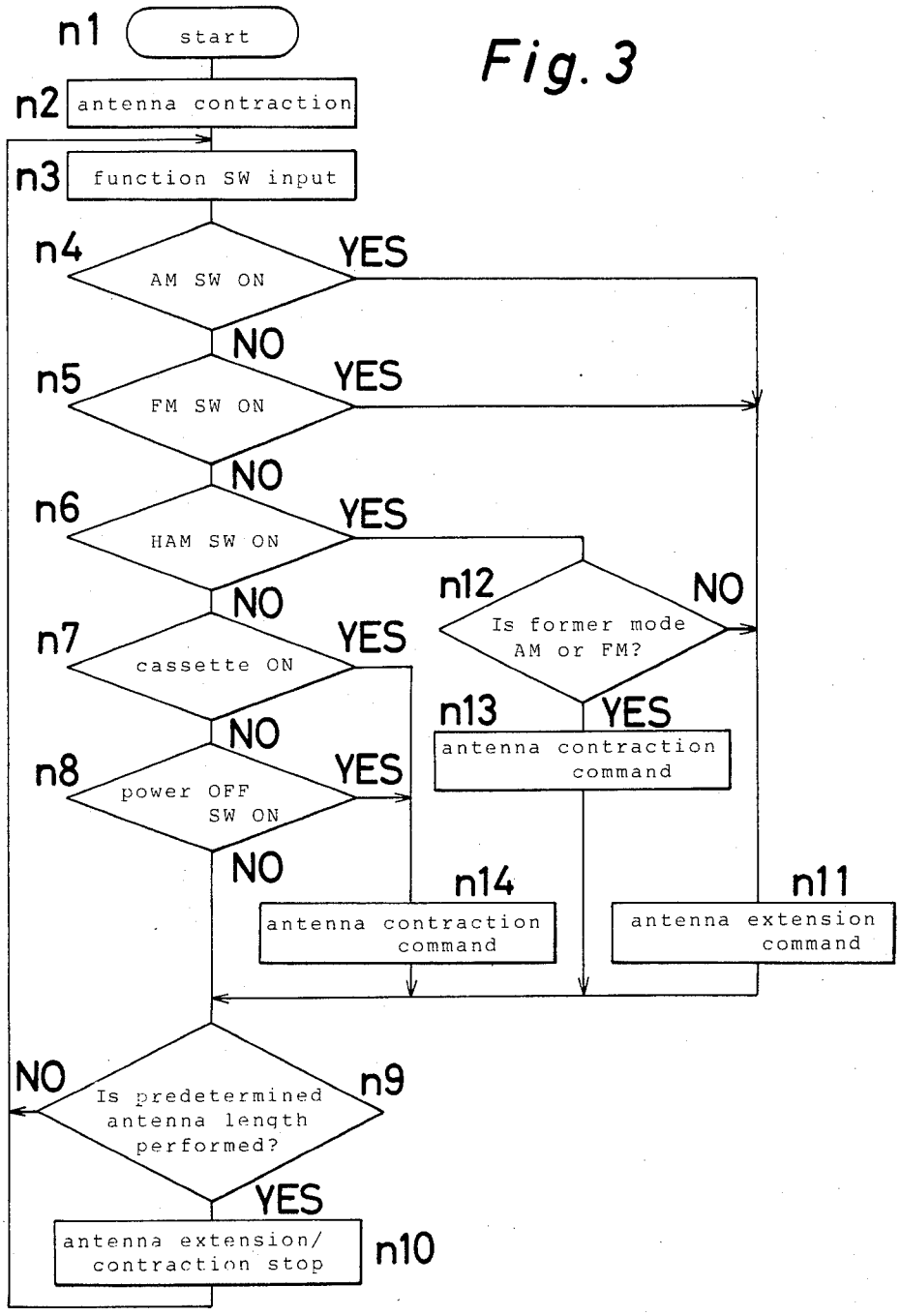
FIG. 3 is a flow-chart for explaining functions of the arrangement in FIG. 1.

| Functioning mode | Antenna functions | Output from input/output interface 19 | |
|---|---|---|---|
| | | Line 35 | Line 38 |
| Power switch 40 cut off | Contraction of antenna 20 to l1 | L | H |
| Cassette tape recording/reproducing apparatus 4 (during reproduction mode) | Contraction of antenna 20 to l1 | L | H |
| Receiver 2 for amplitude modulation broadcast | Extension of antenna 20 to l3 | H | L |
| Receiver 2 for frequency modulation broadcast | Extension of antenna 20 to l3 | H | L |
| Amateur wireless equipment 3 | Extension or contraction of antenna 20 to l2 | Functioning in accordance with the flow-chart of FIG. 3 | |

During the recording mode in Table 1, antenna functions are effected according to the mode of the recording sources (i.e. the receiver 2 for amplitude modulation broadcasts, receiver 2 for frequency modulation broadcasts, and amateur wireless equipment 3) for recording by the cassette tape recording/reproducing apparatus 4.

Referring also to a flow-chart in FIG. 3 explanatory of the functions of the arrangement in FIG. 1, in order to drive the antenna 20, steps are shifted from a step $n_1$ to a step $n_2$, with the line 38 being rendered to be of low level, and the antenna 20 is accommodated into the body of the motor vehicle. At a step $n_3$, the mode selection keys 15*a*, 15*b*, 16 and 17 of the key input device 14, and the power switch 40 are actuated. Upon operation of the key 15*a* for the reception of the amplitude modulation broadcasts, the step is shifted to a step $n_{11}$, with the line 35 rendered to be of high level, and the antenna 20 is driven for extension. When the upper limit length l3 of the antenna 20 is detected by the detector 25 at a step $n_9$, both of the lines 35 and 38 are rendered to be of low level at a step $n_{10}$, and thus, the motor 22 is stopped. Meanwhile, when the key 15*b* is operated for reception of the frequency modulation broadcasts, steps are shifted from a step $n_5$ to the step $n_{11}$.

On the other hand, upon actuation of the key 16 for functioning of the amateur wireless equipment 3, shifting is effected from a step $n_6$ to a step $n_{12}$. At the step $n_{12}$, judgement is made as to whether or not the keys 15*a* and 15*b* are operated prior to the actuation of the key 16. When the keys 15*a* and 15*b* are operated before the operation of the key 16, the antenna 20 is at its upper limit length l3, and therefore, at a step $n_{13}$, the line 35 becomes low level, with the line 38 rendered to be of high level for lowering the antenna 20, and thus, the antenna 20 is contracted. Upon detection of the length l2 of the antenna 20 by the detector 24 at the step $n_9$, the motor 22 is shut down at the step $n_{10}$. Meanwhile, the keys 15*a* and 15*b* are not operated before actuation of the key 16, the antenna 20 is contracted to be at its lower limit length l1, and accordingly, the steps are shifted from the step $n_{12}$ to the step $n_{11}$, with the line 35 rendered to be of high level and the line 38 to be of low level, and thus, the antenna 20 is driven for the extension. When the antenna 20 has attained the length suitable for the amateur or ham band communication, the motor 22 is stopped at the step $n_{10}$ by the output from the detector 24.

When the key 17*b* is actuated for operation of the cassette tape recording/reproducing apparatus 4 at the reproduction mode, the line 35 is rendered to be of low level and the line 38 to be of high level, and the antenna 20 is driven at a step $n_{14}$ so as to reach the lower limit length l1. In the case where the power switch 40 is cut off, with the fact being judged at a step $n_8$, the step is also shifted to the step $n_{14}$. Upon actuation of the key 17*a* for operating the cassette tape recording/reproducing apparatus 4 in the recording mode, the cassette tape recording/reproducing apparatus 4 starts recording. In this case, since the recording source is the receiver 2 or the amateur wireless equipment 3, the lines 35 and 38 for controlling the extension and contraction of the antenna 20 are rendered to be of levels in accordance with the modes of the recording source so as to extend or contract the antenna.

It should be noted here that the present invention as described so far may be effected only for the receiver 2, or merely for a transmitter in which the amateur wireless equipment 3 and the like is included.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An antenna control apparatus for a vehicle-mounted variable length antenna utilized with at least first and second electrical devices, said antenna control apparatus comprising:

a power source for providing power to said apparatus:

a main switch and a processor means, said main switch operatively connected between said processor means and said power source for controlling the power tranmitted therebetween;

a motor mechanically connected to said antenna for varying the length thereof;

a motor drive operatively electrically connected to said motor for providing power thereto, said motor drive operatively electrically connected to said power source for receiving power therefrom and connected to said processor means for receiving control signals so as to operate in response thereto;

at least a first and a second and a third position detector, each of said position detectors detecting a specific length of said antenna, said first and second detectors detecting first and second lengths corresponding to first and second frequencies for which said antenna is of an optimum length and said third detecting means detecting a length of said antenna corresponding to said antenna being withdrawn into said vehicle;

a function switch connected to said processor for providing control input signals thereto;

a third electrical device operatively connected to said processor means, said third device not requiring the use of said antenna;

wherein, when said function switch selects said third electrical device or said power source is opened, said motor causes said antenna to be withdrawn into said vehicle;

and wherein when said function switch respectively selects said first and second electrical devices, said motor causes said antenna to respectively have said first and second lengths corresponding to said first and second frequencies, said first and second frequencies respectively being frequencies being utilized by said first and second electrical devices.

* * * * *

UNITED STATES PATENT AND TRADEMARK OFFICE

CERTIFICATE OF CORRECTION

PATENT NO. : 4,506,266

DATED : March 19, 1985

INVENTOR(S) : Masataka Mizuno, et al.

It is certified that error appears in the above-identified patent and that said Letters Patent is hereby corrected as shown below:

On the title page, Item (73) Assignee should read:
--Fujitsu Ten Limited, Hyogo-Ken, Japan and
Toyota Jidosha Kogyo Kabushiki Kaisha, Aichi-Ken, Japan--.

Signed and Sealed this

*Thirteenth* Day of *August 1985*

[SEAL]

*Attest:*

DONALD J. QUIGG

*Attesting Officer*

*Acting Commissioner of Patents and Trademarks*